US005134977A

United States Patent [19]

Bagger et al.

[11] Patent Number: 5,134,977

[45] Date of Patent: Aug. 4, 1992

[54] ENGINE AIR CLEANER INLET TUBE FOR AUTOMOTIVE ENGINE

[75] Inventors: James E. Bagger, Allen Park; James M. Barba, Farmington Hills; Russell D. Haese, Southfield, all of Mich.

[73] Assignee: Ford Motor Company, Dearborn, Mich.

[21] Appl. No.: 812,269

[22] Filed: Dec. 23, 1991

[51] Int. Cl.[5] ..... F02B 77/00

[52] U.S. Cl. ..... 123/198 E; 55/276

[58] Field of Search ..... 123/198 E; 181/229; 55/276, DIG. 21

[56] References Cited

U.S. PATENT DOCUMENTS

| | | | |
|---|---|---|---|
| 4,077,787 | 5/1978 | Akado et al. | 55/419 |
| 4,420,057 | 12/1983 | Omote et al. | 180/54 A |
| 4,440,555 | 4/1984 | Chicester | 55/385 B |
| 4,699,639 | 10/1987 | Gieseke et al. | 55/385 B |
| 4,778,029 | 10/1988 | Thornburgh | 181/229 |
| 4,790,864 | 12/1988 | Kostun | 55/276 |

*Primary Examiner*—Noah P. Kamen

*Attorney, Agent, or Firm*—Jerome R. Drouillard; Roger L. May

[57] ABSTRACT

An engine air cleaner inlet tube for bringing air from outside the engine compartment of an automotive vehicle to the engine includes an entry section with a generally hemispherical chamber for bringing air drawn from outside the engine compartment, a venturi section having a circular configuration coupled to and extending radially from the hemispherical chamber, and an exit section coupled to the venturi section, with the exit section being adapted for connection with an air cleaner system.

11 Claims, 3 Drawing Sheets

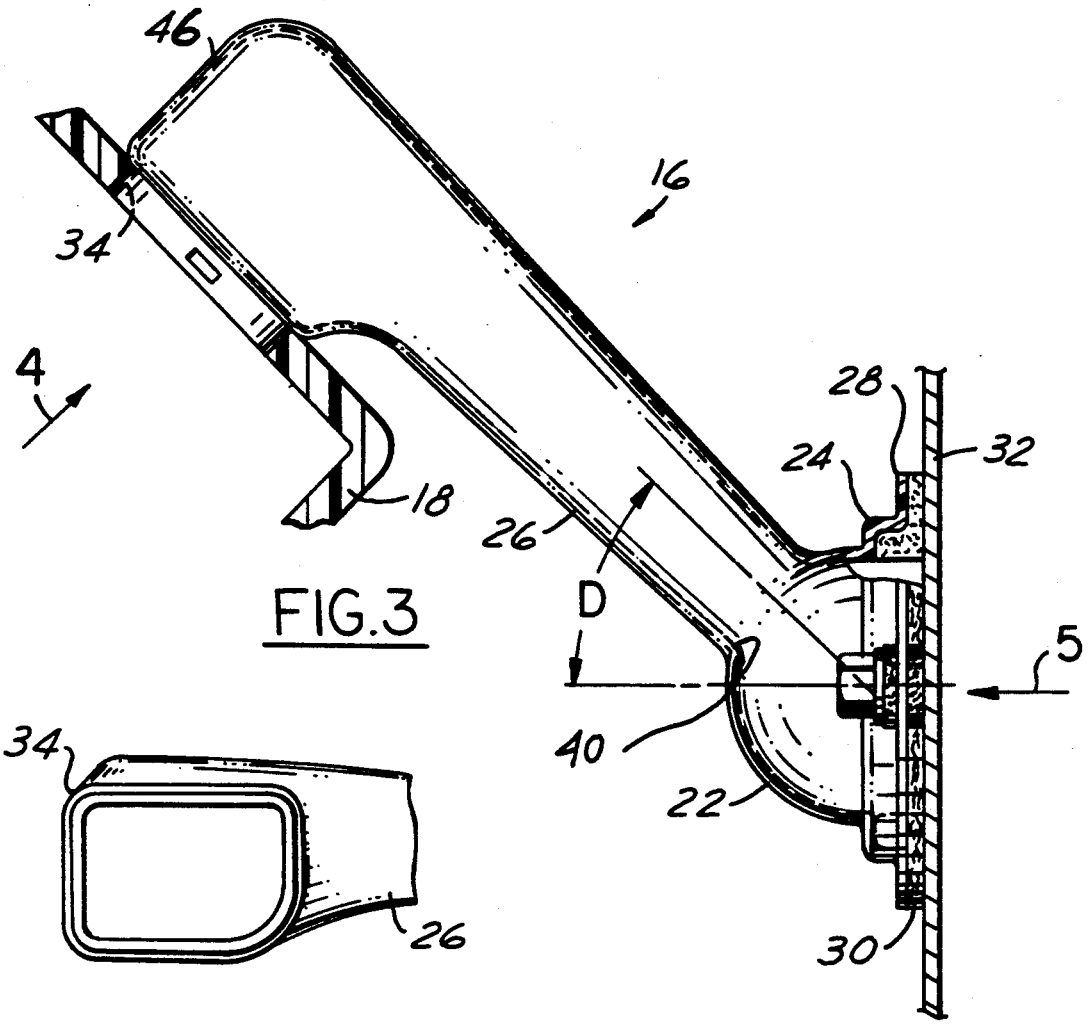
FIG.3
FIG.4
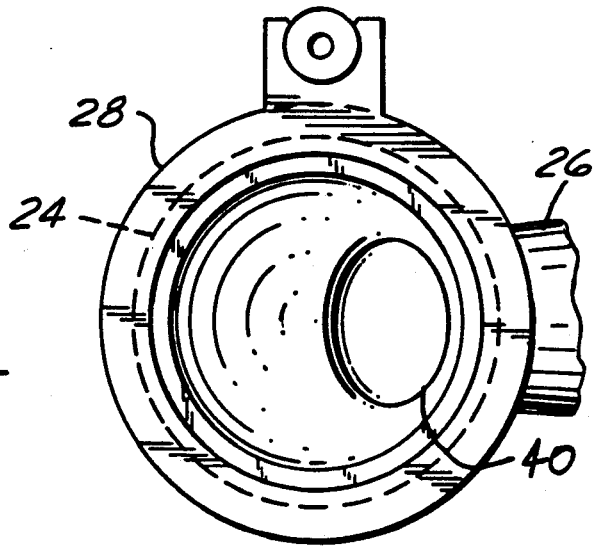
FIG.5

ENGINE AIR CLEANER INLET TUBE FOR AUTOMOTIVE ENGINE

BACKGROUND OF THE INVENTION

1. Field of the Invention

This invention relates to an inlet tube for delivering air to the air cleaner system of an automotive engine.

2. Disclosure Information

Air inlet systems for automotive and industrial vehicles have used a variety of configurations. U.S. Pat. No. 4,077,787 to Akado et al., U.S. Pat. No. 4,440,555 to Chichester, and U.S. Pat. No. 4,699,639 to Gieseke et al. disclose systems for drawing intake air from within the engine compartment of a vehicle itself. Such systems suffer from a deficiency insofar that inducted air will be heated above the ambient temperature by the engine's heat prior to being drawn into the air cleaner system. This is undesirable because it has been determined that the formation of oxides of nitrogen, a regulated automotive exhaust emission constituent, is exacerbated by elevated air intake temperatures. Accordingly, it is one object of the present invention to provide an engine air cleaner inlet tube which allows air to be drawn from outside the engine compartment of an automotive vehicle, but without imposing unnecessary flow restriction upon the passage of engine inlet air through the tube.

U.S. Pat. No. 4,778,029 to Thornburgh, and U.S. Pat. No. 4,790,864 to Kostun disclose automotive air inlet devices incorporating venturi tubes for the purpose of mitigating engine air induction noise. Note that the devices shown in the '029 and '864 patents do not include any type of airflow entry structure for introducing air into the vicinity of the venturi.

U.S. Pat. No. 4,420,057 to Omote et al. discloses an air induction structure for an automotive vehicle which, although drawing air from outside the vehicle through its radiator grill, requires the air to pass immediately through a flattened section having a 90° bend. The restriction caused by this flattened section at higher airflow rates will be considerable.

It is an object of the present invention to provide an engine air cleaner inlet which picks up air from outside the engine compartment of the vehicle and allows the air to flow into the air cleaner system of the vehicle with minimum flow restriction.

It is another object of the present invention to provide an engine air cleaner inlet tube which may be oriented in any one of a plurality of discharge angles, as defined herein, without significantly changing the air inlet restriction.

Other objects, features and advantages of the present invention will become apparent to the reader of this specification.

SUMMARY OF THE INVENTION

An engine air cleaner inlet tube for an automotive vehicle includes a generally spherical entry section for receiving air, a venturi section coupled to the entry section, and an exit section coupled to the venturi section, with the exit section being adapted for connection with an air cleaner system. The entry section is preferably mounted to the engine compartment structure of the vehicle. The venturi is oriented so that it diverges in the direction extending from the entry section to the exit section. The exit section may comprise a transition from a circular configuration in the region of the venturi section to a non-circular configuration in the region adapted for connection with an air cleaner system. According to another aspect of the present invention, an engine air inlet system for an automotive vehicle includes an inlet tube for bringing air into the engine compartment of the vehicle, with the inlet tube comprising an entry section including a hemispherical chamber for receiving air from outside the engine compartment, with the hemispherical chamber having a cylindrical lead element communicating with the hemispherical chamber, and with the cylindrical element having an inside diameter approximating the inside diameter of the hemispherical chamber. The hemispherical chamber is connected with a venturi section having a circular configuration, with the venturi section extending radially from the entry section such that the diameter of the venturi increases as the distance from the entry section increases. An exit section coupled to the venturi section achieves a transition from the circular configuration of the venturi section to the cross-sectional configuration of an air cleaner section which is coupled to the exit section of the inlet tube.

BRIEF DESCRIPTION OF THE DRAWINGS

FIG. 3 is a plan view of an installed air cleaner inlet tube according to the present invention.

FIG. 4 shows the exit section of an air cleaner inlet tube according to the present invention taken from FIG. 3 in the direction of arrow 4.

FIG. 5 illustrates a portion of the entry section of an air cleaner inlet tube according to the present invention, with the view taken in the direction of arrow 5 of FIG. 3.

DETAILED DESCRIPTION OF THE PREFERRED EMBODIMENT

Figure 2:
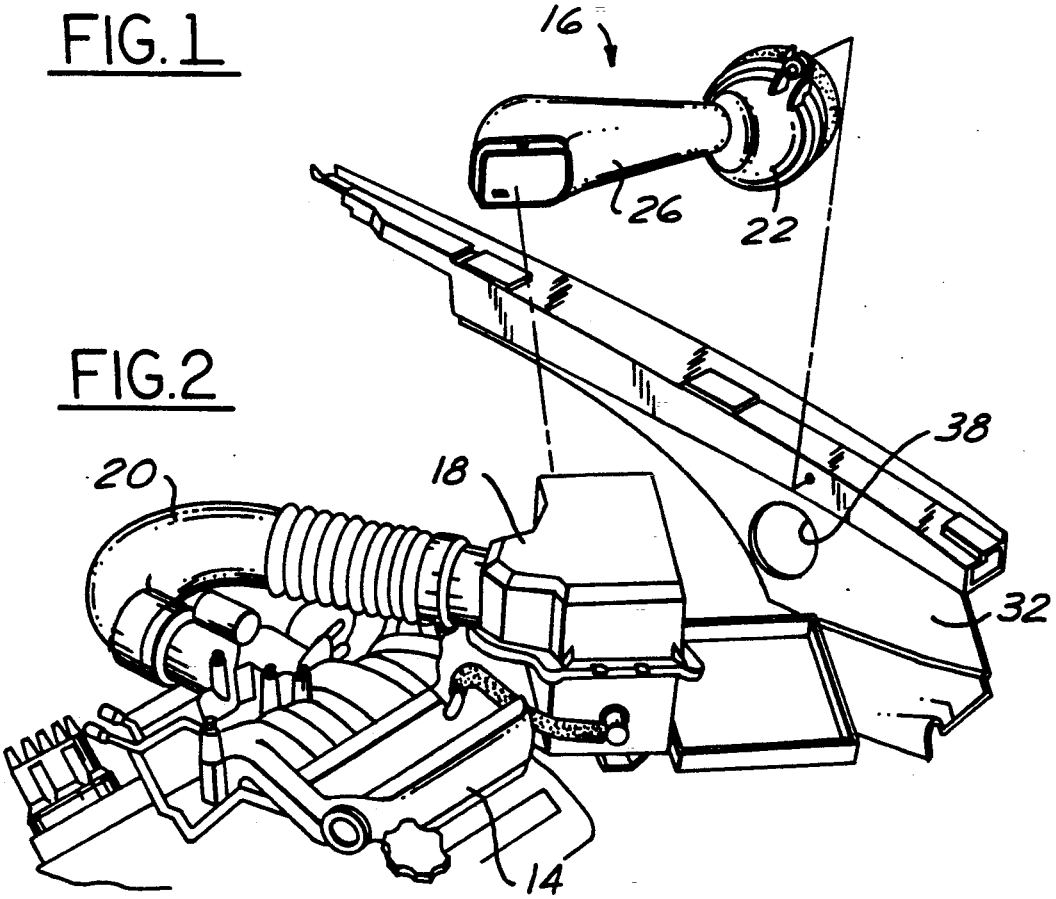
FIG. 2 is a partially exploded perspective view of an engine air inlet tube and air cleaner system according to the present invention.

As shown in FIG. 2, an engine air cleaner inlet tube, 16, according to the present invention is intended to be used in conjunction with an automotive engine, 14, having an air supply tube, 20, fed by an air cleaner, 18, which in turn receives air from an air cleaner inlet tube, 16. Air cleaner inlet tube 16 is mounted to a wall, 32, of the vehicle's engine compartment, which has a circular aperture, 38, formed therein.

An engine air cleaner inlet tube according to the present invention has an entry section including a generally spherical or hemispherical chamber for receiving air from outside the engine compartment. This hemispherical chamber is illustrated as item 22 in FIGS. 2 and 3. A venturi section, 26, having a circular cross section, extends radially from hemispherical chamber 22. The diameter of the venturi increases with the distance from throat 40. This allows the venturi to control the transmission of induction noise arising from the vehicle's air intake system.

As shown in FIG. 3, a discharge angle, D, may be measured as the angular displacement of venturi section 26 from a reference line which is parallel to the direction of initial airflow and which passes through the center of the entry to generally hemispherical chamber 22 (see arrow 5 of FIG. 3). Angle D is a measure of the orientation of venturi 26 with respect to the mounting plane of air inlet tube 16.

Figure 6:
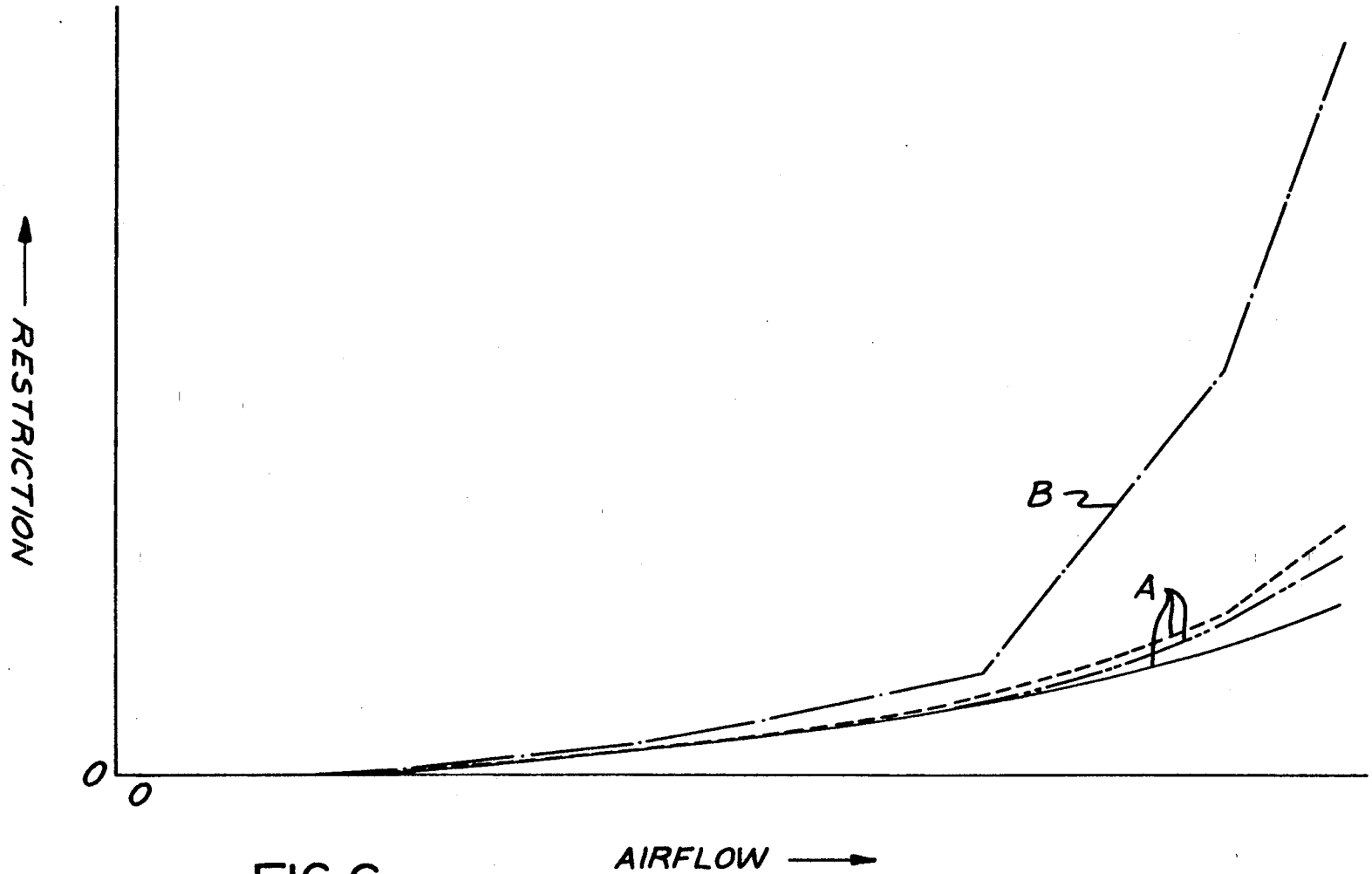
FIG. 6 illustrates an air inlet restriction and airflow plot according to one aspect of the present invention.

FIG. 6 illustrates air inlet restriction plotted against airflow for an air cleaner inlet tube according to the present invention shown as a family of curves A, and for a similarly sized, conically shaped venturi entrance having a 45° angle bend from the entrance portion of the venturi to its longest portion. The curve A representing the highest level of restriction was obtained with an inlet tube according to the present invention using an angle D of 60°. The curve A representing the lowest level of restriction was obtained with an inlet tube according to the present invention using an angle D of 0°. Curve B was generated using a conical shaped venturi entrance having a discharge angle of only 45°. Accordingly, it is easily seen that a generally spherical entry section according to the present invention will allow increased airflow at lower flow restriction than would be expected with other types of devices.

Figure 1:
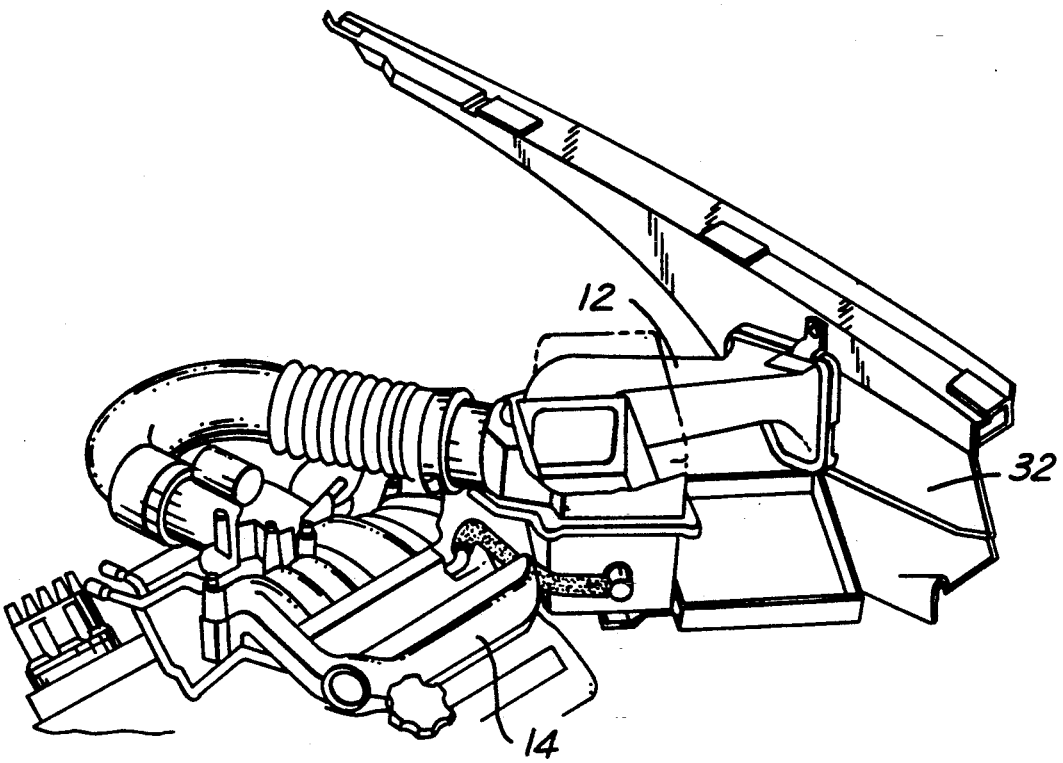
(PRIOR ART) FIG. 1
FIG. 1 illustrates a prior art air supply tube and air cleaner system.

The prior art air inlet tube shown as item 12 in FIG. 1 has at least two major deficiencies. First, air entering the tube must move along flow paths having multiple, grossly differing, radii, and this will cause turbulence and disrupt the flow, thereby increasing the pressure drop. Second, if it is desired to reorient the discharge angle of the prior art device shown in FIG. 1, the flow will change significantly because air does Pass through different flow paths. The restriction to flow of prior art tube 12 will exceed the restrictions shown for the family of curves "A" in FIG. 6. If discharge angle D of an air inlet tube 16 according to the present invention is changed, the family of curves A of FIG. 6 will apply for discharge angles of up to 60°. FIGS. 3 and 5 clearly show that for a considerable range of discharge angle, the airflow path remains substantially unchanged. This is significant because automotive engineers frequently need to relocate components within engine compartments. If such relocation necessitates the reconfiguration of the air inlet tube, the present invention allows the discharge angle to be modified without significantly changing the performance characteristic of the inlet tube. This is beneficial because the burden of recalibrating the engine control to handle altered airflow will be obviated.

As shown in FIG. 3, air cleaner inlet tube 16 is mounted to wall 32 of the vehicle's engine compartment by means of flange 28 and gasket 30. Air cleaner inlet tube 16 picks up air through aperture 38 formed in wall 32. Because aperture 38 is circular, the flow area into inlet tube 16 generally exceeds the area for the inlet tube shown in FIG. 1, at an equivalent package space. Upon entering the air cleaner inlet tube, the air first passes through cylindrical lead element 24 and then into generally spherical chamber 22. Lead element 24 allows the air to smoothly flow into chamber 22. This smooth flow is aided by gasket 30, which allows the air to pass without having to negotiate stepped wall surfaces. If desired, a flange (not illustrated) may be rolled inwardly from wall 32 so as to form a side wall for aperture 38. In any event, gasket 30 serves not only to prevent the infiltration of underhood air which has been heated by engine 14 into inlet tube 16, but also prevents mechanical contact of inlet tube 16 with wall 32.

After flowing through generally hemispherical chamber 22, air passes through throat 40 and into venturi section 26. The illustrated venturi section has been found to function effectively as a noise attenuator without excessive pressure drop if an included angle of approximately 6° is formed by diametrically opposite wall sections of the venturi. Those skilled in the art will appreciate in view of this disclosure that the length of venturi section 26 is tunable so as to permit at least partial recovery of the pressure lost because of venturi throat 40. And, although not illustrated, a side branch resonator or Helmholtz resonator could be added to venturi section 26 to further attenuate induction noise. It will be appreciated further that the diameter of venturi throat 40 may be sized so as to attenuate noise in a particular frequency. After flowing through venturi section 26, air passes through exit section 46 coupled to venturi section 26, and then the air flows into air cleaner 18. The profile of non-circular discharge orifice 34, which comprises a part of exit section 46, is illustrated in FIG. 4. Those skilled in the art will appreciate in view of this disclosure, however, that the size and shape of the discharge orifice 34 may be adapted to the needs of the engine air inlet system at hand.

While the invention has been shown and described in its preferred embodiment, it will be clear to those skilled in the art that many changes and modifications may be made thereto without departing from the scope of the invention. For example, although the air cleaner inlet tube according to the present invention is of unitary construction, a component according to this invention could be made of various modules assembled into a completed assembly.

We claim:

1. An engine air cleaner inlet tube for bringing air from outside the engine compartment of an automotive vehicle to the engine, comprising:
   - an entry section comprising at least a generally hemispherical chamber for receiving air drawn from outside the engine compartment;
   - a venturi section, having a circular configuration, coupled to and extending radially from said chamber; and
   - an exit section coupled to said venturi section, with said exit section being adapted for connection with an air cleaner system.

2. An air cleaner inlet tube according to claim 1, wherein said entry section is mounted to the engine compartment structure of said vehicle.

3. An air cleaner inlet tube according to claim 1, wherein said venturi diverges in the direction extending from said entry section to said exit section.

4. An air cleaner inlet tube according to claim 1, wherein said exit section comprises a transition from a circular configuration in the region of said venturi section to a non-circular configuration in the region adapted for connection with an air cleaner system.

5. An air cleaner inlet tube according to claim 1, wherein said inlet tube comprises a unitary structure.

6. An engine air cleaner inlet tube for bringing air into the engine compartment of an automotive vehicle and for conducting such air to an air cleaner system, comprising:
   - an entry section comprising a generally hemispherical chamber for receiving air from outside the engine compartment, with said entry section being mounted to the engine compartment structure of said vehicle;
   - a venturi section, having a circular configuration, which is coupled to and which extends radially from the entry section, such that the diameter of the venturi increases as the distance from the entry section increases; and an exit section coupled to said venturi section, with said exit section comprising a circular configuration in the region of said venturi section, with said exit section being adapted for connection with an air cleaner system.

7. An air cleaner inlet tube according to claim 6, wherein said exit section has a circular configuration in the region of the venturi section, which transitions into a non-circular configuration for connection with an air cleaner system.

8. An air cleaner inlet tube according to claim 6, wherein said inlet tube comprises a unitary structure.

9. An engine air inlet system for an automotive vehicle, comprising:

an inlet tube for bringing air into the engine compartment of said vehicle, comprising:

an entry section comprising a generally hemispherical chamber for receiving air from outside the engine compartment, with said entry section being mounted to the engine compartment structure of said vehicle;

a venturi section, having a circular configuration, which is coupled to and which extends radially from the entry section, such that the diameter of the venturi increases as the distance from the entry section increases;

an exit section coupled to said venturi section, with said exit section comprising a circular configuration in the region of said venturi section; and an air cleaner section coupled to to the exit section of the inlet tube.

10. An engine air inlet system according to claim 9, wherein said air cleaner section is coupled directly to said air inlet tube.

11. An engine air inlet system according to claim 9, wherein said entry section further comprises a cylindrical lead element communicating with said generally hemispherical chamber, with said cylindrical element having an inside diameter approximating the inside diameter of said hemispherical chamber.

* * * * *